US005318303A

United States Patent [19]

Kim

[11] Patent Number: 5,318,303

[45] Date of Patent: * Jun. 7, 1994

[54] PUTTING GREEN WITH ADJUSTABLE TOPOGRAPHY AND MULTI-BALL RETURN

[76] Inventor: Samuel Kim, 3820 Charlemagne Dr., Hoffman Estates, Ill. 60195

[ * ] Notice: The portion of the term of this patent subsequent to Mar. 31, 2009 has been disclaimed.

[21] Appl. No.: 831,410

[22] Filed: Feb. 5, 1992

Related U.S. Application Data

[63] Continuation-in-part of Ser. No. 578,568, Sep. 6, 1990, Pat. No. 5,100,145, which is a continuation-in-part of Ser. No. 485,296, Feb. 26, 1990, Pat. No. 5,087,045.

[51] Int. Cl.[5] ..... A63B 67/02

[52] U.S. Cl. ..... 273/176 H

[58] Field of Search ..... 273/176 H, 34 A, 178 B, 273/179 R, 179 B, 179 A, 179 C, 176 K, 179 E

[56] References Cited

U.S. PATENT DOCUMENTS

| | | | |
|---|---|---|---|
| 1,662,864 | 3/1928 | Petersen | 273/176 H |
| 1,761,039 | 6/1930 | Hazeltine | 273/176 H |
| 2,118,084 | 5/1938 | Heinzelman | 273/176 H |
| 2,678,823 | 5/1954 | Hugman | 273/176 H |
| 3,508,756 | 4/1970 | Bedford, Jr. | 273/176 H |
| 3,690,673 | 9/1972 | Occhipinti | 273/176 H |
| 3,727,917 | 4/1973 | MacLean | 273/176 H |
| 4,240,637 | 12/1980 | Cross | 273/176 H |
| 5,087,045 | 2/1992 | Kim | 276/176 H |

*Primary Examiner*—Theatrice Brown

*Attorney, Agent, or Firm*—Laff, Whitesel, Conte & Saret

[57] ABSTRACT

A golf putting assembly comprising a playing mat having a putting end, a ball cup end, and a ball cup in the ball cup end, a mechanism for adjusting the playing mat to a selected one of multiple topographies, and a ball return mechanism for inclining the ball cup end of the playing mat toward the putting end, thereby gravitationally causing all balls on the ball cup end to return to the putting end.

10 Claims, 8 Drawing Sheets

122
134
A
120
102
182
202
204
112
164
118
168
186
100
108
166
143
156
208
140
182
114
158
142
132
182
198
200
110
164
178
148
210
106
170
104
182
212
116
150
152
196
192
194
154
142

122
134
A
120
124
102
136
144
126
140
144
144
132
128
138
144
148
106
160
130
142
152
154
150

PUTTING GREEN WITH ADJUSTABLE TOPOGRAPHY AND MULTI-BALL RETURN

This is a continuation-in-part of Ser. No. 07/578,568, filed Sep. 6, 1990 (U.S. Pat. No. 5,100,145), which is a continuation-in-part of Ser. No. 07/485,296, filed Feb. 26, 1990 (U.S. Pat. No. 5,087,045).

FIELD OF THE INVENTION

This invention relates to a practice putting green for golfers. More particularly, this invention relates to a practice putting green assembly for golfers that includes an adjustable topography and multi-ball return mechanism.

BACKGROUND OF THE INVENTION

A variety of practice putting greens for golfers are known. These putting greens may be portable, as, for example, the greens often found in homes or offices, or they may be stationary or permanently fixed to an area, such as the greens found in amusement parks or game rooms. Regardless of whether these prior putting greens are portable or stationary, they basically are similar in their structure and mode of operation. For example, most existing portable and stationary greens have fixed slopes, or no slope at all. Usually, if there is a slope, the slope is upward toward the cup, to accommodate the depth of the cup and to avoid digging a hole in the underlying surface. Furthermore, most existing portable and stationary greens usually require the golfer to retrieve each putted ball from the cup or the area surrounding the cup by approaching the cup and stooping to pick it up. While some of the existing greens include a ball retrieval mechanism, these mechanisms usually involve systems which only remove the ball found in the cup, and not balls unsuccessfully putted in the area surrounding the cup. Also, these mechanisms generally only return one ball at a time, so that a golfer must wait for a ball in the cup to be returned before hitting another ball. In some cases, these ball-in-the-cup retrieval mechanisms do not operate to return the putted ball to the golfer, but instead, the balls are returned to a holding box as a theft preventative measure. Such holding boxes are typically found in amusement parks or game rooms.

Thus, while the existing portable and stationary putting greens offer the golfer the basic essentials—a green with no or a fixed slope and a cup for the ball—they are extremely limited in their structure and operation and, consequently, unrealistic and uninteresting.

Accordingly, an object of the present invention is to provide a putting green assembly having an adjustable slope of multiple variations.

Another object of the present invention is to provide a putting green assembly having a multi-ball return mechanism.

Another object of the present invention is to provide a putting green assembly in which the area of the green surrounding the cup need not be elevated to accommodate the depth of the cup.

Another object of the present invention is to provide a putting green assembly that may be adjusted in length for chipping or longer putting.

Another object of the present invention is to provide a putting green assembly that retains misdirected balls on the playfield.

Still another object of the present invention is to provide a putting green assembly that is collapsible for easy shipping and storage purposes.

A further object of the present invention is to provide a putting green assembly which is portable.

Yet a further object of the present invention is to provide a putting green assembly which may be used indoors or outdoors.

SUMMARY OF THE INVENTION

The present invention accomplishes the foregoing objects by providing a putting green assembly comprising, in part, an adjustable slope and multi-ball return mechanism. Generally, the putting green assembly in each embodiment comprises a combination slope elevation and multi-ball return mechanism which is operated manually. This combination slope elevation and multi-ball return mechanism is itself elevated above and straddles a playing mat at that end of the green assembly where the cup is located. The combination mechanism includes a plurality of rope members or cords hung along a lattice. The cords extend to and are attached at various locations to the playing mat or to a frame structure that partially or completely extends around the perimeter of the playing mat. In the first embodiment, the rope members or cords are attached to the exterior of the lattice by a plurality of rings. In the second and third embodiments, the rope members or cords extend through the interior channel of the lattice and are held in the desired position by detent a mechanism. In the fourth and fifth embodiments, the rope members or cords are attached to both the interior and the exterior of the lattice and are held by a plurality of rings and at least one hook.

The slope of the playing mat in all of the above embodiments is changed by releasing or hitching the cords at certain points. The putted balls lying around or inside the cup are all returned simultaneously by pulling a specific return cord or rope on the combination mechanism to incline the playing mat toward the putter.

The above, as well as other objects and advantages of the invention, will become apparent from the following detailed description of the preferred embodiments, reference being made to the accompanying drawings.

DETAILED DESCRIPTION OF THE INVENTION

Figure 1:
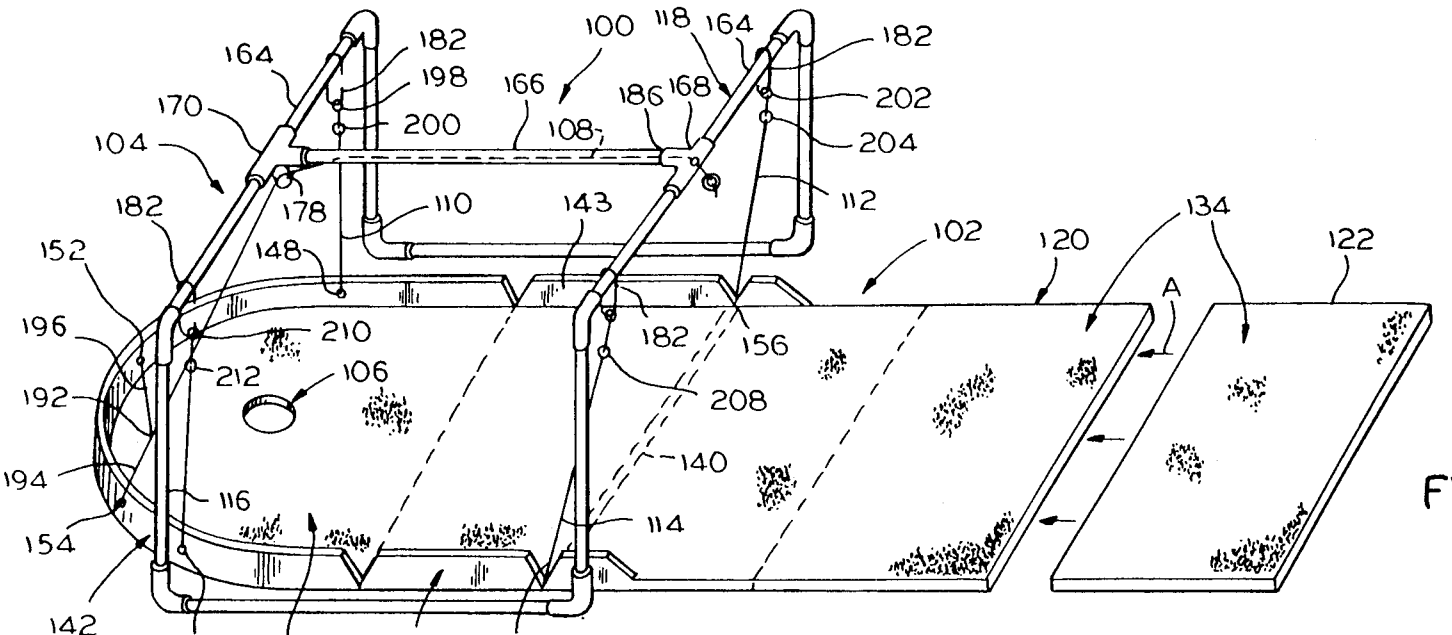
FIG. 1 is a perspective view of a first embodiment of the inventive putting green assembly.

Referring to the first embodiment shown in FIGS. 1-9, a putting green assembly is generally denoted by the numeral 100, and includes, in part, an elongated putting green or playing mat 102, a combination slope-elevation and multi-ball retrieval mechanism 104 and ball cup 106. As used herein, the term "multi-ball retrieval mechanism" means a mechanism capable of returning multiple balls simultaneously toward the putter. Cords or rope members 108, 110, 112, 114 and 116 are supported and extend from the exterior of lattice 118 preferably to a frame structure that extends entirely or partially around the perimeter of playing mat 102, and enable a player to manually adjust the elevation and topography of playing mat 102 The cords may also be extended and attached directly to the playing mat.

Figure 2:
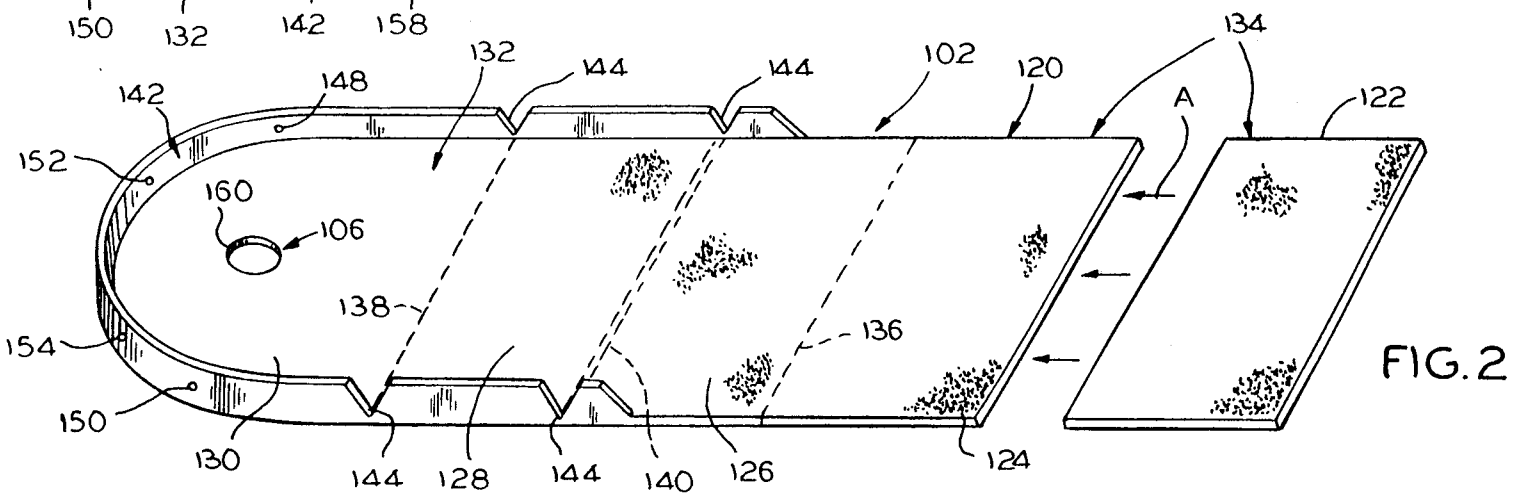
FIG. 2 is a perspective view of the playing mat of the inventive putting green assembly of FIG. 1.

Referring to FIG. 2, playing mat 102 generally comprises two separable sections 120 and 122 of typical artificial grass carpeting with a foam backing. Section 120, the primary putting surface, is approximately nine feet in length and three feet in width. Section 122 is optionally used for chipping or to extend the putting mat and is approximately three feet in length and two feet in width. Both sections 120 and 122 are approximately $\frac{3}{4}$" to 1 inch in thickness which thickness comprises a backing material covered by an artificial grass carpet. These dimensions have been found suitable, but other dimensions may be equally suitable.

Putting section 120 is preferably a unitary mat which includes four foldable subsections 124, 126, 128 and 130. Sections 128 and 130 comprise the ball cup end 132 of the playing mat 102, whereas section 124 or the optional extension section 122 is the putting end 134 of the mat 102. Subsection 124 and subsection 126 may optionally be divided by a first perforation 136 which extends across the width of playing mat 102. Subsection 128 and subsection 130 may optionally be divided by a second perforation 138 which also extends across the width of playing mat 102. The boundary of subsection 126 and subsection 128 is marked by a metal plate strip 140 which extends transversely across the frame structure and beneath playing mat 102. Several of the cord members may be attached to strip 140 which is then used to elevate or lower the playing mat.

A plastic frame structure 142 extends partially around the perimeter of playing mat 102. The frame structure has a generally L-shaped cross section and includes a vertical section 143 which extends above mat 102 a distance of two to four inches and a horizontal section (not shown) which extends beneath and supports playing mat 102. The vertical section 143 of frame 142 includes a plurality of V-shaped breaks 144 which are located at each end of second perforation 138 and at the ends of metal plate strip 140. Breaks 144 allow for subsections 126, 128 and 130 to hingedly move along the perforations relative to each other. Frame 142 further includes holes 148, 150, 152, 154, 156 and 158. The vertical section 143 retains misdirected balls on the playing mat 102.

Section 122 may be attached to section 120 when needed, as indicated by the arrows A in FIGS. 1 and 2, and serves as an extension or chipping mat.

Subsections 126, 128 and 130 include a flexible sponge backing beneath the overlying artificial grass carpet. Subsection 124 of section 120 and section 122 each include a hard styrofoam backing beneath the overlying artificial grass carpet.

Figure 3:
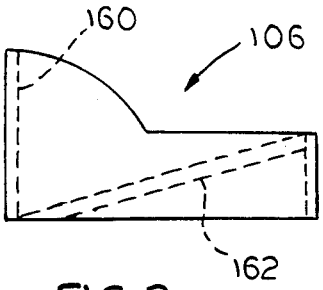
FIG. 3 is a side view of the ball cup illustrated in FIG. 1.

Ball cup 106, as illustrated in FIGS. 1-3, is located in subsection 36. It is circular and has approximately a $4\frac{1}{8}$ inch diameter. Ball cup 106 includes a rim 160 which extends around approximately one-half of the circumference of cup 106, and preferably around that portion of the cup rim most distant from the golfer.

Rim 160 extends above the surface of subsection 130 a distance of approximately one inch. The bottom 162 of cup 106 is inclined, with its lowest surface intersecting that portion of cup 106 which is below the rim 160 (i.e., the bottom inclines downwardly away from the golfer). Rim 160, in conjunction with the inclined bottom 162 of cup 106, effectively retains a ball which enters the cup.

Figure 4:
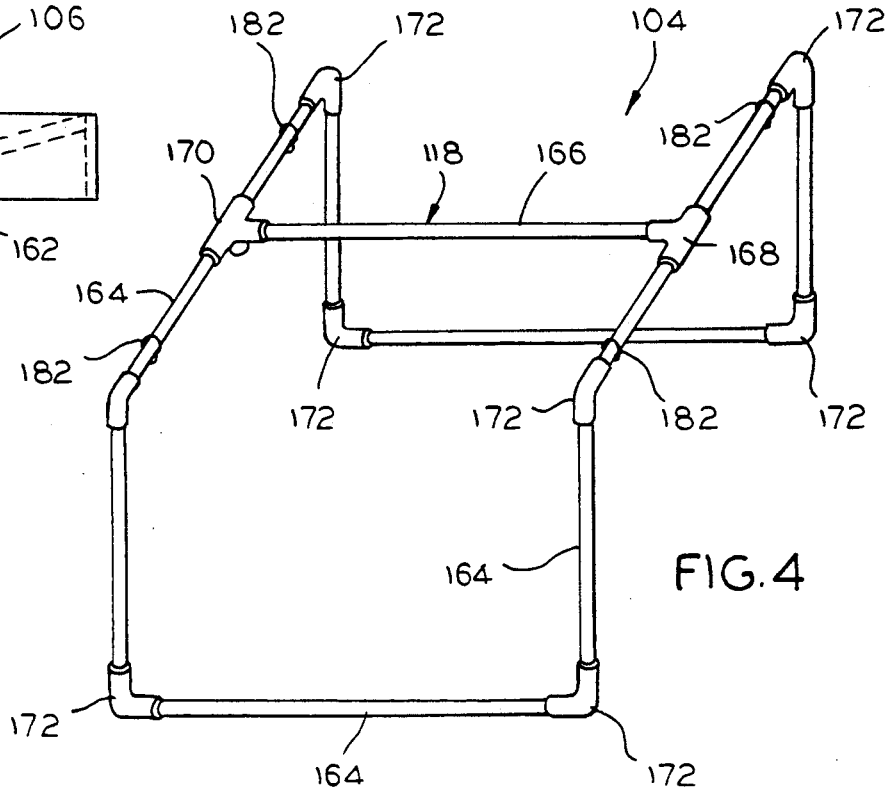
FIG. 4 is a perspective view of the combination slope-elevation and multi-ball retrieval mechanism of the inventive putting green assembly of FIG. 1.
Figure 5:
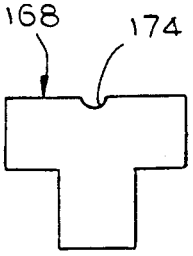
FIG. 5 is a plan view of a T-joint used to secure the piping of the combination slope-elevation and multi-ball retrieval mechanism of FIG. 1.
Figure 6:
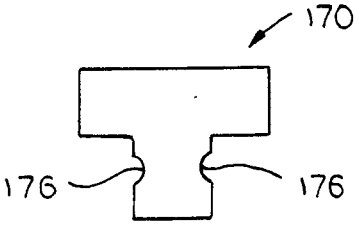
FIG. 6 is a plan view of an elbow joint used to secure the piping of the combination slope-elevation and multi-ball retrieval mechanism of FIG. 1.
Figure 7:
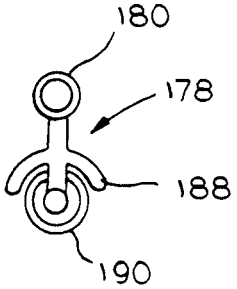
FIG. 7 is a plan view of a roller which is attached to the T-joint illustrated in FIG. 6.
Figure 8:
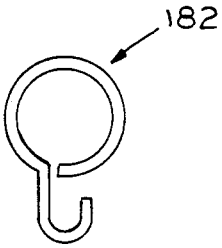
FIG. 8 is a plan view of an o-ring with hooked projection used to adjust the elevation of the putting green assembly shown in FIG. 1.
Figure 9:
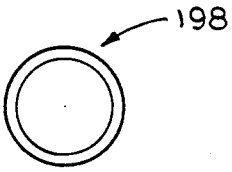
FIG. 9 is a plan view of an o-ring used to adjust the elevation of the putting green assembly of FIG. 1.

Referring to FIG. 4, the lattice 118 generally comprises a plurality of segments or pipes 164, 166, such as polyvinyl chloride (PVC) piping, connected by various connectors, as for example, T-joints 168, 170 and elbow joints 172. Both T-joints 168 and 170 include openings, 174 and 176, respectively (see FIGS. 5 and 6). T-joint 170 further includes a roller 178 (see FIG. 7) which is attached to T-joint 170 through openings 176 by ring 180.

Lattice 118 of the first embodiment further includes a plurality of o-rings with hooked projections 182 (see FIGS. 4 and 8) which are located on upper pipes 164. These hooked rings 182 will be described in more detail later.

As previously mentioned and as shown in FIG. 1, lattice 118 is positioned above cup 106 of subsection 130 of section 120. Lattice 118 is attached to section 120 at numerous locations by cord members 108, 110, 112, 114 and 116.

Cord member 108 is secured to lattice 118 at T-joint 168, as shown in FIG. 1. A first ring 184 is attached to the one end of cord member 108. Cord member 108 passes into T-joint 168 through opening 174 (see FIG. 5) and then passes out of T-joint 168 at opening 186. Cord member 108 extends in parallel relationship to pipe 166 until it reaches roller 178, whereupon cord member 108 is threaded between roller shield 188 and wheel 190 (see FIG. 7). Cord member 108 extends away from roller 178 whereupon it splits at point 192 and forms a forked section made up of segments 194 and 196. Segments 194 and 196 extend through openings 152 and 154 of frame 142.

Cord members 110, 112, 114 and 116 each extend downwardly from pipe 164 to a different location along frame 142 or to metal plate strip 140. Cord member 110 includes a first o-ring 198 at its one end which is attached to pipe 164 at hooked ring 182. Cord member 110 includes a second o-ring 200 which is positioned immediately below first o-ring 198 (see FIG. 9). Cord member 110 extends downwardly whereupon it attaches to frame 142 through opening 148.

Cord members 112, 114 and 116 are attached in the same manner as cord member 110. Cord member 112 includes a first o-ring 202 at its one end which is attached to pipe 164 at hooked ring 182. Cord member 112 includes a second o-ring 204 below the first o-ring 202. Cord member 112 is attached to frame 142 through an opening 156.

Cord member 114 has a first o-ring 206 which is attached to hooked ring 182. A second o-ring 208 is positioned immediately below. Cord member 114 is attached to frame 142 through an opening 158.

Cord member 116 has first o-ring 210 which is attached to hooked ring 182. A second o-ring 212 is positioned immediately below. Cord member 116 is attached to frame 142 through opening 150.

The elevation and slope adjustment of playing mat 102 is effectuated by adjusting the length of cord members 110, 112, 114 and 116, which is accomplished by hooking either the first o-ring or the second o-ring of any of the cord members onto hooked ring 182. For example, one of the numerous slopes may be formed by attaching cord member 110 to hooked ring 182 by second o-ring 200, and then attaching cord members 112, 114 and 116 to hooked ring 182 by first o-ring 202, 206 and 210, respectively. Then, to create a different slope from the above slope configuration, one may simply place second o-ring 212 of cord member 116 onto hooked ring 182. The cord members may be adjusted in this manner to elevate or lower selected portions of the playing mat and thereby create sixteen different slopes for playing mat 102. The first and second perforations, 136 and 138, respectively, allow frame 142 to bend so that the topography of playing mat 102 may be changed by cord members 112 and 114.

To retrieve a ball from ball cup 106 or from the ball cup end 132 which is the area surrounding cup 106, a golfer simply pulls return ring 184. As previously mentioned, return ring 184 is attached to cord member 108 which is in turn attached to frame 142 of section 120. Thus, when return ring 184 is pulled, ball cup end 132 is inclined toward the vertical along second perforation 138 and metal strip 140. The incline created by pulling ring 184 causes any balls lying on ball end 132 or in the cup to roll under the force of gravity towards putting end 134 at the other end of playing mat 102. Since cup 106 includes a sloped bottom 162, any ball inside of cup 106 also will easily roll out once playing mat 102 is inclined. After the balls have been cleared from ball end 132, ring 184 is released by the golfer to lower ball end 132 to its previously selected elevation.

Referring to FIGS. 10–13, a second embodiment is shown which is similar in structure to that of the first embodiment shown in FIGS. 1 and 4, except that cord members 308, 310, 312, 314 and 316 of the second embodiment extend through the interior of and in parallel relation to a plurality of hollow segments or pipes 364, 366 which comprises the lattice 318. The playing mat 302 and ball cup 306 of the second embodiment are the same as in the first embodiment. This embodiment protects and conceals the cord members and may be more aesthetically pleasing.

Figure 12:
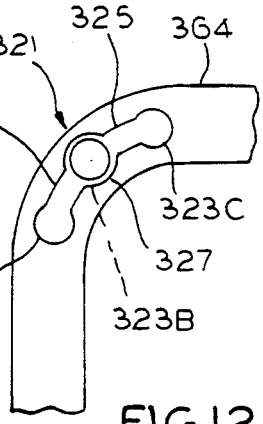
FIG. 12 is a fragmentary side view of the detent mechanism illustrated in FIG. 11.
Figure 13:
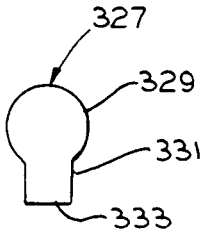
FIG. 13 is a side view of the protuberance that slides within the detent mechanism illustrated in FIG. 12.
Figure 14:
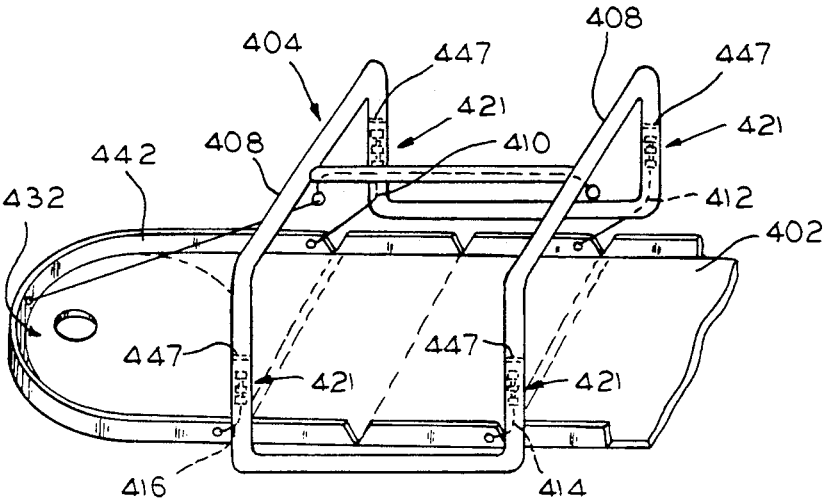
FIG. 14 is a perspective view of a third embodiment of the inventive putting green assembly.
Figure 16:
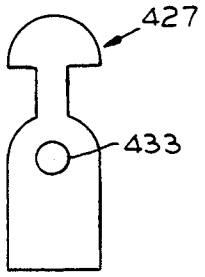
FIG. 16 is a side view of the knob that is a part of the detent mechanism illustrated in FIG. 15.
Figure 18:
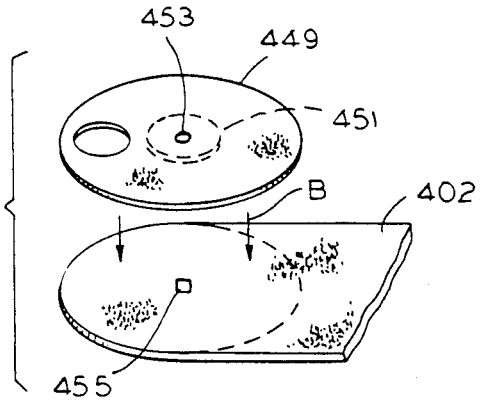
FIG. 18 is a fragmentary perspective view of the rotating hole of the playing mat shown in FIG. 17.

Lattice 318 includes a detent mechanism 321 which is located on each of upper pipes 364. Detent 321 comprises a plurality of recesses 323A, 323B, 323C that are interconnected by slots 325 (see FIG. 12). Slots 325 are more narrow in Width than recesses 323. A protuberance or knob 327 (see FIG. 13) connected to the cord members is adapted to slidably move within the narrow slots 325 between the plurality of recesses 323A, 323B, 323C. Knob 327 includes a bulbous head portion 329 and a neck portion 331, as shown in FIG. 18. A small ring 333 attaches to the bottom of neck portion 331. The cord members attach to knob 327 through small ring 333. Once positioned in one of recesses 323A, 323B, 323C, knob 327 is locked into place. FIG. 12 shows knob 327 as it appears positioned in recess 323B of detent 321.

Figure 10:
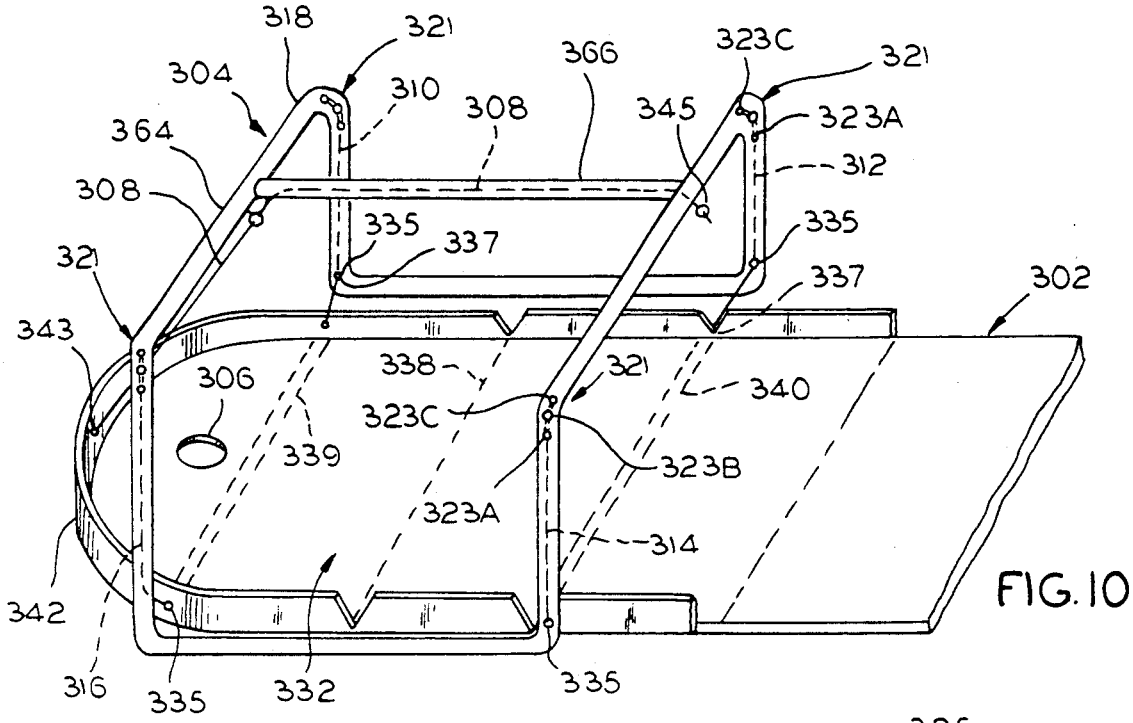
FIG. 10 is a perspective view of a second embodiment of the inventive putting green assembly.
Figure 11:
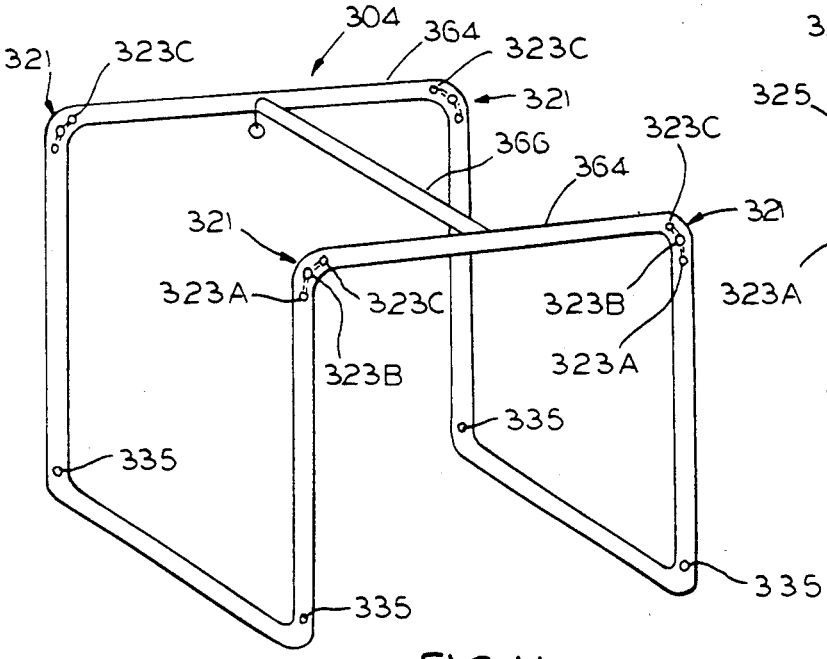
FIG. 11 is a perspective view of the combination slope-elevation and multi-ball retrieval mechanism of the inventive putting green assembly of FIG. 10.

Cord members 310, 312, 314, and 316 each extend downwardly from knob 327 through the interior of pipe 364 until they exit out of pipe 364 through openings 335 and attach to an opening 337 in either frame 342 or in metal plate strips 340 and 339 (see FIG. 10).

Cord member 308 extends in parallel relationship to and through the interior channel of pipe 366 until it exits at one end from opening 341, passes through ring 372 and attaches to an opening 343 of frame 342 of playing mat 302. Member 308 exits from pipe 366 at the other end through opening 345 and attaches to ring 384.

The elevation and slope adjustment of playing mat 302 of the second embodiment is effectuated by adjusting the length of cord members 310, 312, 314 and 316, which is accomplished by sliding knob 327 through slots 25 into recesses 323B or 323C. For example, the positioning of knob 327 in recess 323A creates a flat topography on playing mat 302. Then, to Create a slope on mat 302, knob 327 is moved to either recess 323B or 323C. The cord members may be adjusted in this manner to selectively create sixteen different slopes for playing mat 302.

To retrieve a ball from ball cup 306 or from the ball cup end 332 which is the area surrounding cup 306, ring 384 is pulled towards the player and away from lattice 318. As mentioned previously, ring 384 is attached to cord member 308 which is in turn attached to frame 342 of mat 302. Thus, when ring 384 is pulled, ball cup end 332 is inclined toward the vertical along perforation 338 and metal strip 340 and moves upwardly, causing balls lying on end 332 to roll away from and out of cup 306 towards the player.

Referring to FIGS. 14–18, a third embodiment is shown which is similar in structure to that of the second embodiment shown in FIGS. 10–13, except that detent mechanism 421 is different and playing mat 402 includes a rotatable portion.

Figure 15:
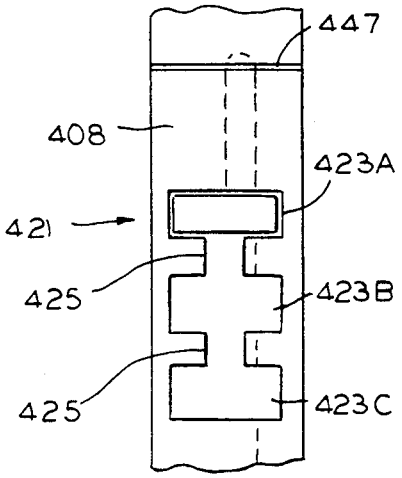
FIG. 15 is a fragmentary side view of the detent mechanism illustrated in FIG. 14.

Detent mechanism 421 comprises a plurality of recesses 423A, 423B, 423C that are interconnected by channels 425 similar to those illustrated in the second embodiment (see FIG. 15). Likewise, a protuberance or knob 427 (see FIG. 16) is connected to the cord members and slidably moves within channels 425 between the recesses. The cord members attach to knob 427 through an opening 433. However, the third embodiment further includes a horizontally oriented pin 447 which is located above each detent mechanism 421 and which receives cord members 410, 412, 414, 416 which extend upwardly from knob 427, loop around pin 447, and then extend downwardly to frame 442 of playing mat 402. Pin 447 serves to reduce the amount of stress on the upper portion of pipes 408.

Figure 17:
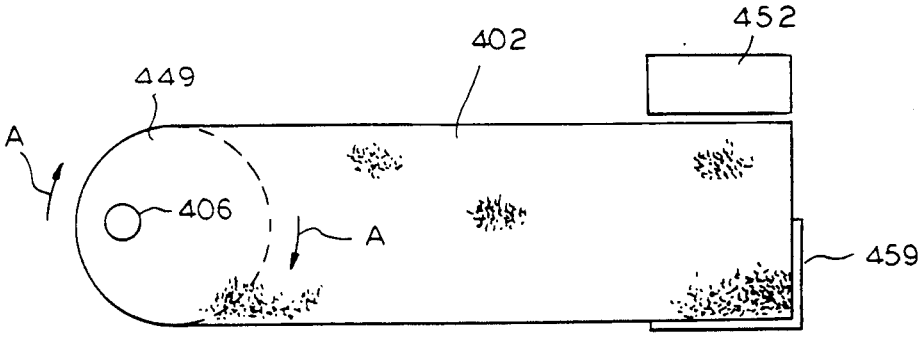
FIG. 17 is a perspective view of the playing mat of the putting green of FIG. 14.

Playing mat 402 ma further include a rotatable portion 449 which rotates in a clockwise direction, as indicated by arrows A in FIG. 17. Portion 449 is detachable from playing mat 402 and includes a small disc 451 and a pivot receptacle 453 on its bottom side. Portion 449 rotates on mat 402 by inserting or mounting receptacle 453 onto a pivot 455 as indicated by arrows B (see FIG. 18).

Ball cup 406 is located on rotatable portion 449 and assumes a location on mat 402 which is determined by the rotation and position of portion 449.

FIG. 17 further shows a portable standing mat 457 and guard rail 459 which may be positioned on one longitudinal side of mat 402 or the other to accommodate either left or right handed players. The standing mat places the putter's feet on the same level as the putting end of the playing mat. Both the first and second embodiments, along with subsequent embodiments, may include a standing mat.

The elevation and slope adjustment of playing mat 402 of the third embodiment is effectuated in the same manner as described in relation to the second embodiment. Likewise, balls are retrieved from the ball cup end 432 by the same technique described previously. This embodiment shows multiple ball cups 506 which are located on ball cup end 432.

Figure 19:
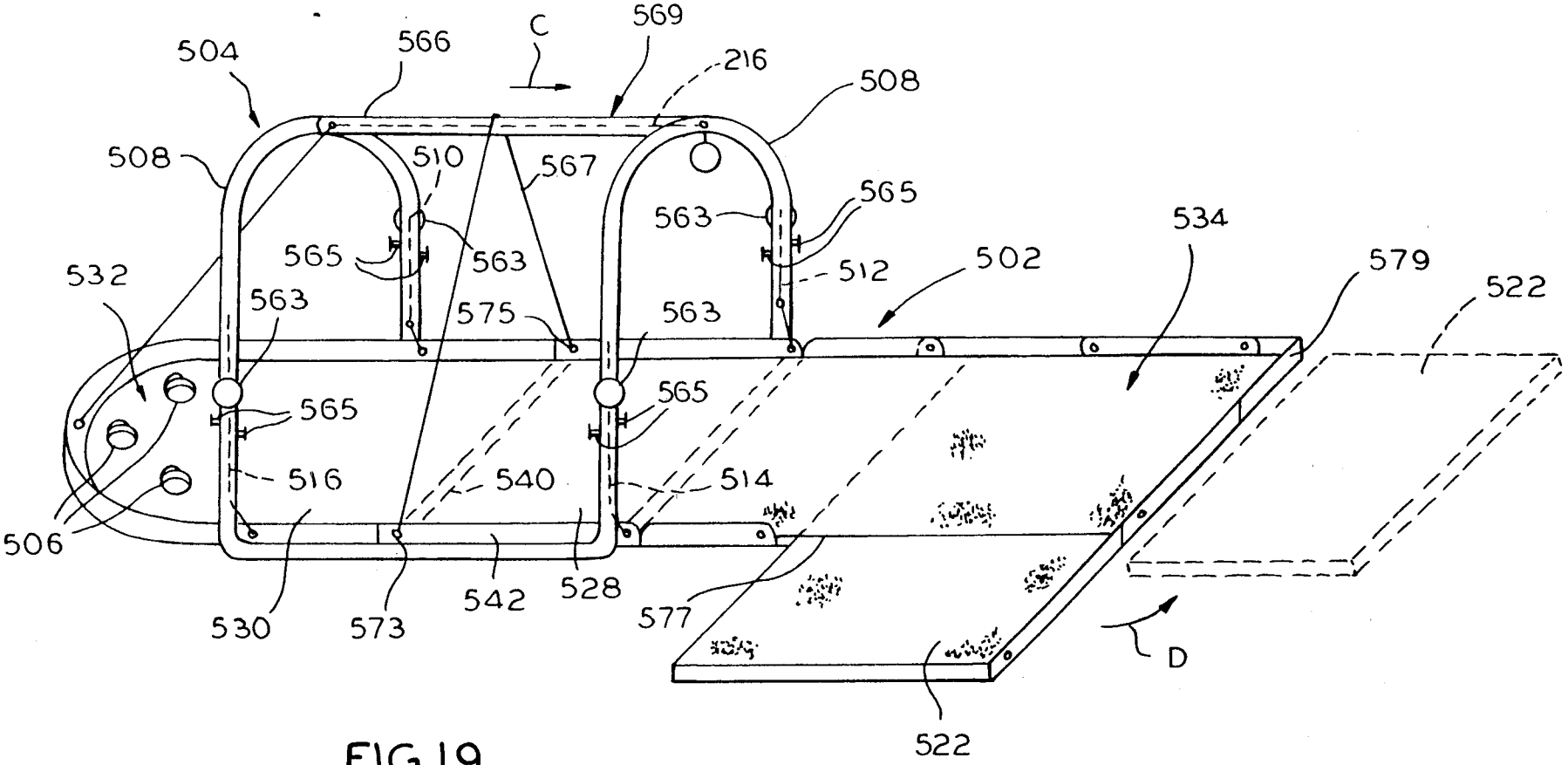
FIG. 19 is a perspective view of a fourth embodiment of the inventive putting green assembly.

A fourth embodiment is shown in FIG. 19 which generally is similar in structure to a combination of the first and second or third embodiments shown in FIGS. 1-18, except that cord members 510, 512, 514 and 516 extend partially through and emerge from the interior of segments or pipes 508. The cords may be attached by a plurality of ring members 563 to a plurality of side hooks 565 that project outwardly from the exterior of the segments. The rings 563 are hooked over the various side hooks 565 to adjust the elevation and slope of playing mat 502, as described in relation to the previous embodiments. Moreover, this embodiment also includes an additional cord member 567 that may be hooked over a single top hook 569 (FIG. 19) and which may further be used to elevate playing mat 502.

In greater detail, cord member 567 extends upwardly from playing mat 502 and straddles segment 566. Cord member 567 is used to adjust the elevation and slope of playing mat 502 by moving member 567 in the direction of arrow C and attaching same to a top hook 569. The movement of cord member 567 changes the topography and elevation of playing mat 502 by causing sections 528 and 530 of the playing mat to fold slightly along metal plate strip 540 in the same manner that was discussed in relation to the previous embodiments. The elevation and slope of mat 502 may then further be adjusted by manually lowering or raising cord member 567 at points 573 or 575 so that one side or the other of mat 502 is elevated. Playing mat 502 remains elevated by its own weight.

The playing mat 502 in this embodiment further includes a section 522 which serves as a standing or extension chipping mat (See FIG. 19). Section 522 places the putter's feet on the same level as the putting end of the playing mat and may adjoin mat 502 along one of its two longitudinal sides when needed or desired. As shown in FIG. 19, a frame 542 extends partially around the perimeter of playing mat 502. This frame enables section 522 to be placed flush with the longitudinal side 577 of playing mat 502 at putting end 534 by removing the corresponding frame section, or section 522 may be placed at the remote end 579 of mat 502 as indicated by the arrow D.

A fifth embodiment is shown which is similar to the fourth embodiment except for the frame structure. As shown in FIGS. 20-25, playing mat 602 of the fifth embodiment is supported and retained by a frame structure 691 that includes a series of interconnected, vertically and horizontally extending segments 683. The vertical segments consist of interconnected ridges 642 that extend around the perimeter of playing mat 602. The horizontal segments are bottom portions 685 which extend beneath and support the periphery of playing mat 602. Bottom portions 685 are integrally formed with and perpendicular to the vertically extending ridges. The interconnected edges of ridges 642 form an outer barrier or boundary around the playing mat which prevents putted balls from inadvertently leaving the playing mat. In this embodiment, frame 681 extends completely around the perimeter.

Figure 21:
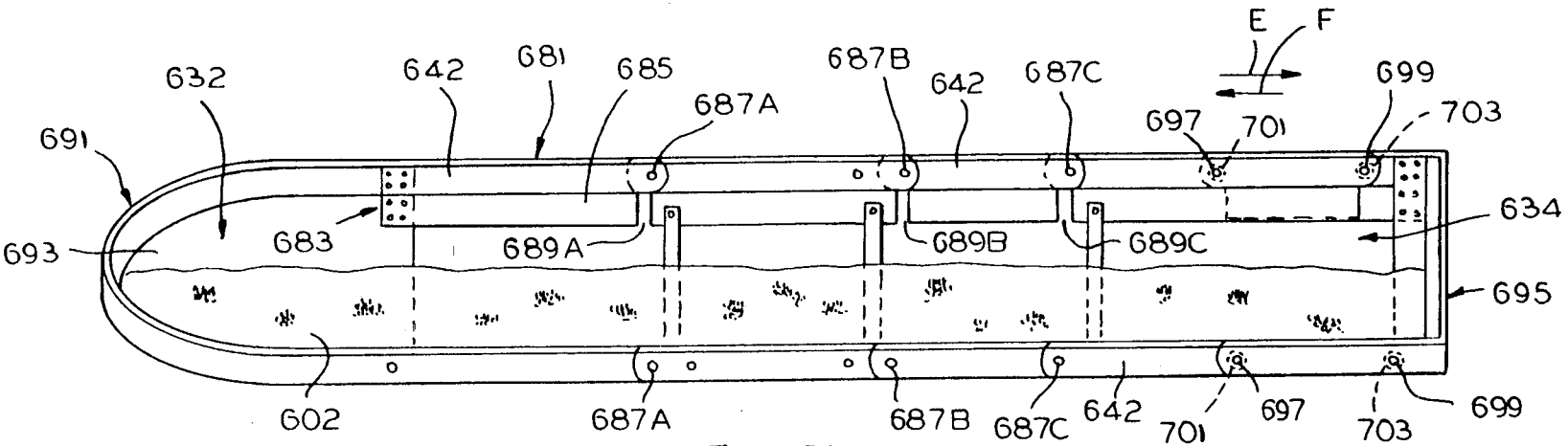
FIG. 21 is a perspective view of the frame structure of FIG. 20 with the playing mat partially in section.

The vertical edges of ridges 642 overlap one another and are connected to each other by a plurality of pivot pins 687A, B and C See FIG. 21). Adjacent to pivot pins 687A, B, C and between bottom portions 685 are gaps 689A, B, C. Gaps 689A, B, C and pivot pins 687A, B, C allow frame structure 681 to fold, as will be described in further detail later.

A front end or ball cup end 691 of the frame structure includes a semicircular bottom surface or floor 693 for additional stability of the frame and support of playing mat 602. At the opposite end of the mat, segments 683 are also attached to a back portion 695 of frame 681 in a similar manner.

Figure 20:
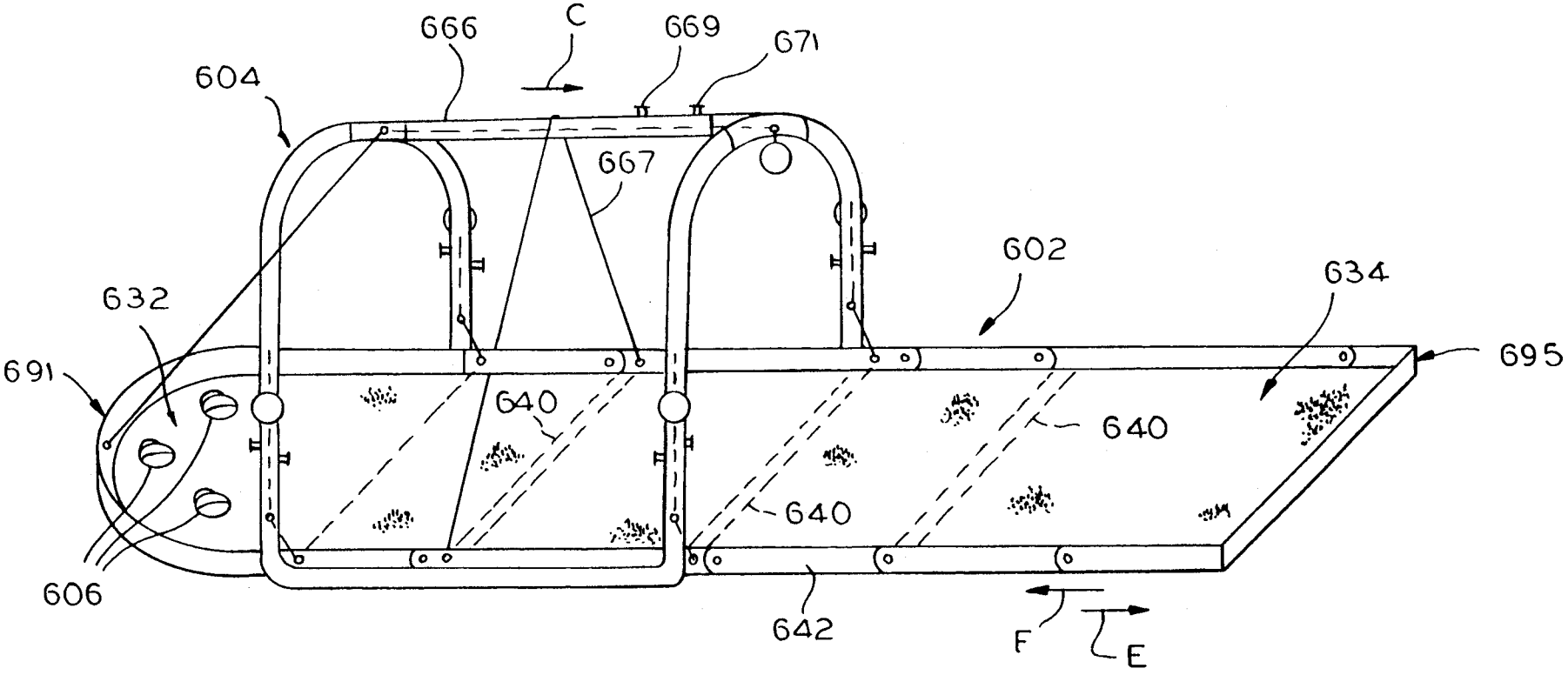
FIG. 20 is a perspective view of a fifth embodiment of a putting green according to the present invention.
Figure 22:
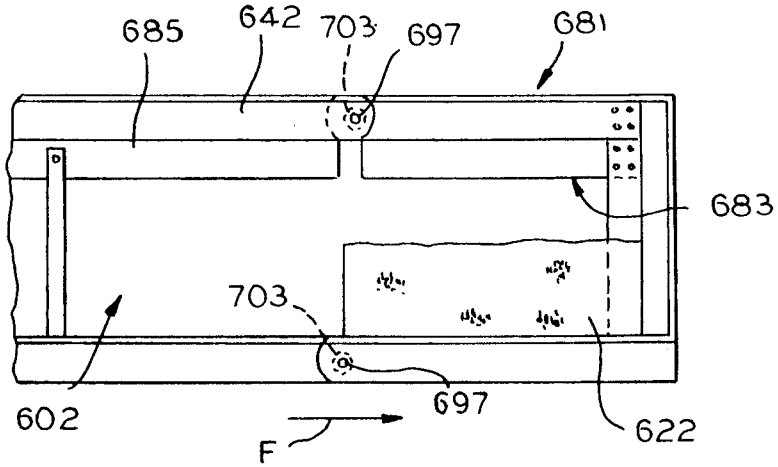
FIG. 22 is a fragmentary perspective view of the structure of FIG. 21, illustrating its slidably movable frame.

As shown in FIGS. 20-22, part of frame structure 681 is slidably movable in the longitudinal direction of arrows E and F, to accommodate the addition of an extension or chipping mat at the putting end 634 of playing mat 602, if desired. Specifically, back portion 695 is detachable from the frame structure at front pegs 697 and rear pegs 699 which lock the adjacent segments together by protruding into front and rear openings 701 and 703, respectively, on ridge 642. The frame is extended by pushing pegs 697 and 699 out from openings 701, 703, sliding back portion 695 in the direction shown by arrow F in FIG. 22, and then snapping pegs 697 into rear openings 703. Chipping mat 622 may then be placed adjacent to the playing mat and inside of ridge 642. The frame structure may be decreased in size and returned to its original configuration by removing chipping mat 622 from the frame and then sliding the putting end 634 of the frame towards the ball cup end 691 of the frame so pegs 697 and 699 are aligned with and may be snapped into openings 701 and 703 in ridge 642.

Figure 23:
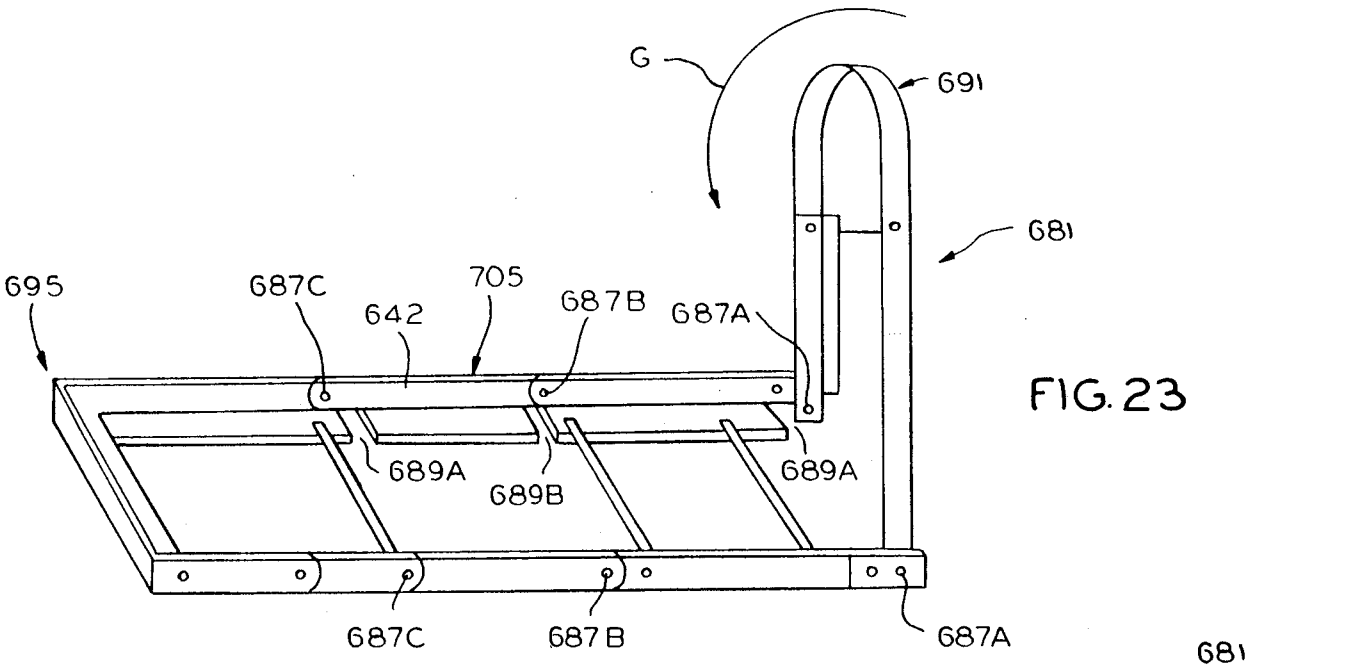
FIG. 23 is a perspective view of the frame of FIG. 21, illustrating the initial folding of its first section.
Figure 25:
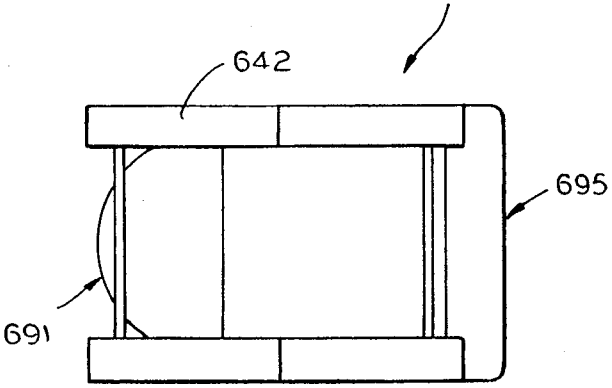
FIG. 25 is a top plan view of the frame of FIGS. 23 and 24, illustrating its appearance subsequent to folding all sections.
Figure 24:
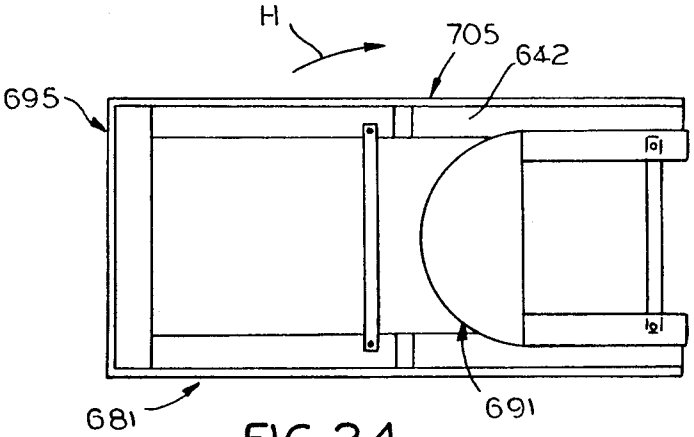
FIG. 24 is a top plan view of the frame of FIG. 23, illustrating its appearance subsequent to folding the first section.

FIGS. 23 through 25 illustrate the manner in which frame structure 681 is collapsed for storage or shipping. As previously mentioned, pivot means 687A, B, C and gaps 689A, B, C allow frame structure 681 to fold.

Frame structure 681 is collapsed by first pivoting front end 691 around pivot means 687A, in the direction indicated by arrow G in FIG. 23, so that front section 691 folds onto the middle section 705 of the frame structure. Next, rear portion 695 is likewise pivoted around pivot means 687C, in the direction of arrow H in FIG. 24, so that it folds onto and over front section 691 and middle section 705 of the frame structure (see FIG. 25). Gaps 689A and 689C, along with the pivot means, allow for the folding of the frame structure.

Metal strips 640 extend transversely across the frame structure and are attached thereto by bolts (not shown) or any other suitable attachment mechanism. The metal strips underlie playing mat 602 and, together with bottom portions 685 of the frame, support the adjacent portions of the playing mat as its topography is adjusted.

Similarly to the fourth embodiment, the fifth embodiment includes an additional cord member 667 that straddles segment 666. In contrast to the previous embodiment, cord member 667 may be hooked over a first top hook 669 or a second top hook 671.

Cups 606 and the other various components illustrated in the fifth embodiment are the same as those shown in the fourth embodiment.

It should be recognized that, while the invention has been described in relation to five embodiments, those skilled in the art may develop a wide variation of structural details without departing from the principles of the invention. Therefore, the appended claims are to be construed to cover all equivalents falling within the true scope and spirit of the invention.

The invention claimed is:

1. A putting green assembly comprising:

a playing mat having a putting end, a ball cup end, and a ball cup in said ball cup end;

means for adjusting a topography of said playing mat, wherein said adjusting means includes a flexible frame structure extending at least partially around the perimeter of and supporting said playing mat, a lattice fixed over said playing mat, and at least one elongated member extending along said lattice and fixed to said frame structure for manually raising or lowering said frame structure and said supported playing mat, thereby adjusting the topography of said playing mat; and ball return means for inclining said ball cup end of said playing mat toward said putting end, thereby changing the topography of said playing mat and gravitationally causing all putted balls on said ball cup end to return to said putting end.

2. The putting green assembly of claim 1 wherein said ball return means includes an elongated member extending from said lattice and fixed to said frame structure at said ball cup end of said playing mat so as to incline substantially said entire ball cup end toward said putting end.

3. The putting green assembly of claim 1 wherein said frame structure comprises a plurality of flexibly interconnected segments.

4. The putting green assembly of claim 3 wherein said segments are pivotally interconnected.

5. The putting green assembly of claim 4 wherein said frame structure is foldable.

6. The putting green assembly of claim 3 wherein at least one of said segments is slidably interconnected with an adjacent segment, thereby allowing the size of the frame structure and the playing mat supported therein to be changed.

7. The putting green assembly of claim 6 wherein said frame structure is foldable.

8. The putting green assembly of claim 1 wherein said frame structure includes a ridge extending above said playing mat for retaining misdirected balls on said playing mat.

9. The putting green assembly of claim 3 wherein said ball cup end is detachable from, and rotatable relative to said playing mat.

10. The putting green assembly of claim 3 further comprising an extension mat which adjoins and is coplanar with said playing mat.

* * * * *